US010677208B2

(12) United States Patent
Hosaka et al.

(10) Patent No.: US 10,677,208 B2
(45) Date of Patent: Jun. 9, 2020

(54) FUEL INJECTION DEVICE

(71) Applicant: Hitachi Automotive Systems, Ltd., Hitachinaka-shi, Ibaraki (JP)

(72) Inventors: Tomoyuki Hosaka, Tokyo (JP); Eiji Ishii, Tokyo (JP); Yoshihiro Sukegawa, Tokyo (JP); Taisuke Sugii, Tokyo (JP); Kazuki Yoshimura, Tokyo (JP); Kazuhiro Oryoji, Tokyo (JP); Masayuki Saruwatari, Hitachinaka (JP)

(73) Assignee: HITACHI AUTOMOTIVE SYSTEMS, LTD., Hitachinaka-shi (JP)

( * ) Notice: Subject to any disclaimer, the term of this patent is extended or adjusted under 35 U.S.C. 154(b) by 0 days.

(21) Appl. No.: 15/568,282

(22) PCT Filed: Apr. 8, 2016

(86) PCT No.: PCT/JP2016/061470
§ 371 (c)(1),
(2) Date: Oct. 20, 2017

(87) PCT Pub. No.: WO2016/170999
PCT Pub. Date: Oct. 27, 2016

(65) Prior Publication Data

US 2018/0149127 A1 May 31, 2018

(30) Foreign Application Priority Data

Apr. 21, 2015 (JP) ..... 2015-086386

(51) Int. Cl.
*F02M 61/10* (2006.01)
*F02M 61/18* (2006.01)

(52) U.S. Cl.
CPC ..... *F02M 61/10* (2013.01); *F02M 61/18* (2013.01)

(58) Field of Classification Search
CPC ..... F02M 61/10; F02M 61/18
See application file for complete search history.

(56) References Cited

U.S. PATENT DOCUMENTS 4,890,794 A * 1/1990 Imafuku ..... F02M 51/0678 239/533.12
5,080,287 A * 1/1992 Takeda ..... F02M 51/0675 239/533.12

(Continued)

FOREIGN PATENT DOCUMENTS

DE 10 2010 030344 A1 12/2011
JP H03-182682 A 8/1991

(Continued)

OTHER PUBLICATIONS

International Search Report with English translation and Written Opinion issued in International Application No. PCT/JP2016/061470 dated Jun. 28, 2016.

(Continued)

*Primary Examiner* — Christopher S Kim
(74) *Attorney, Agent, or Firm* — Foley & Lardner LLP

(57) ABSTRACT

Provided is a fuel injector that is capable of reducing penetration. The fuel injector of the present invention includes a valve body having a valve body side seat surface, a valve seat side seat surface that abuts on the valve body side seat surface, and an injection hole that is provided downstream of a position at which the valve body side seat surface abuts on the valve seat side seat surface. The valve body has a projection that is formed from the valve body side seat surface toward the injection hole, and the projection is formed to be smaller in a direction of fuel flow between seats than a radius of an upstream opening surface of the injection hole.

10 Claims, 14 Drawing Sheets

(56) References Cited

U.S. PATENT DOCUMENTS

| | | | | |
|---|---|---|---|---|
| 5,163,621 | A | 11/1992 | Kato et al. | |
| 7,360,722 | B2 * | 4/2008 | Stockner | F02M 61/1873 239/533.12 |
| 2007/0108317 | A1 * | 5/2007 | Boecking | F02M 45/086 239/533.12 |

FOREIGN PATENT DOCUMENTS

| | | | |
|---|---|---|---|
| JP | 2009-121342 | A | 6/2009 |
| JP | 2010-048140 | A | 3/2010 |
| WO | WO 03/040543 | A1 | 5/2003 |
| WO | WO 2014/057866 | A1 | 4/2014 |

OTHER PUBLICATIONS

Extended European Search Report dated Oct. 29, 2018 in Application No. 16783020.7.

* cited by examiner (a)

(b)

(a)

(b)

FUEL INJECTION DEVICE

TECHNICAL FIELD

The present invention relates to a fuel injector that is used in an internal combustion engine, such as a gasoline engine, and to a controller of the fuel injector.

BACKGROUND ART

In recent years, there has been an increasing demand to improve fuel efficiency of gasoline engines in automobiles. Cylinder injection engines that inject fuel directly into a combustion chamber and ignite a mixture of injected fuel and intake air with a spark plug to cause an explosion have become popular as an engine with high fuel efficiency. However, in cylinder injection engines, the fuel tends to adhere to the inside of the combustion chamber, making it necessary to suppress particle matter (PM) that is generated by incomplete combustion of the fuel adhered to the lower temperature wall. To solve this problem and to develop direct injection engines with low fuel consumption and low emissions, it is essential to optimize combustion inside the combustion chamber.

There are various driving conditions involved in the driving of an automobile such as high load driving, low load driving, and cold start. To optimize combustion, it is important to create an optimum mixture of fuel spray injected into the engine cylinder and air according to the driving conditions. A promising method for optimizing the fuel spray includes variable spraying which changes the length (penetration) of the fuel spray. Since the environment inside the combustion chamber differs depending on the driving condition, for example, to obtain a large output during high load driving, homogeneous combustion, which distributes the fuel spray throughout the combustion chamber by increasing the penetration, is required. To reduce fuel usage during low load driving, stratified charge combustion, which creates a fuel rich region near the spark plug by decreasing the penetration, is required. There is thus a need to provide a fuel injector that optimizes the shape of the fuel spray, and a controller of the fuel injector.

Additionally, since the fuel is injected inside a small combustion chamber in cylinder injection engines, the fuel tends to adhere, for example, to the piston and the inside of the combustion chamber. The fuel that adheres to the wall can be reduced by quickly vaporizing the fuel. Thus, in cylinder injection engines, fuel injection pressure is increased to promote atomization of the fuel spray. However, when the fuel injection pressure is set high, injection velocity increases and penetration tends to increase. Thus, from the point of view of reducing PM emission levels, there is an increasing demand particularly to reduce penetration.

For example, PTL 1 describes a fuel injector that is capable of changing the penetration of fuel injection by controlling a lift amount (movement amount) of a valve body of the fuel injector. In the fuel injector described in PTL 1, the valve body can be set to a plurality of lift amounts of a large lift amount and a small lift amount. The valve body that opens and closes injection holes is provided with protrusions in portions facing each injection hole, and the fuel is caused to go around the protrusions and flow into the injection holes from lateral portions and downstream portions of the injection holes. This gives a swirl component to the fuel injected from the injection holes so that the penetration is controlled to be reduced in the small lift amount. In the large lift amount, a swirl flow is not generated and the penetration is increased. Thus, the penetration can be changed according to the lift amount.

CITATION LIST

Patent Literature

PTL 1: Japanese Unexamined Patent Application Publication No. 2009-121342

SUMMARY OF INVENTION

Technical Problem

PTL 1 describes the fuel injector that is capable of changing the penetration of the fuel spray. However, in general, in a velocity field inside the injection hole of the fuel injector, a velocity component in an injection hole axial direction is relatively much greater than a swirl direction velocity component (swirl direction component) in a plane parallel to an injection hole axis. Thus, in the method described in PTL1 that utilizes the swirl flow, the effect of reducing the penetration is limited.

In view of the above problem, it is an object of the present invention to provide a fuel injector that is capable of reducing penetration.

Solution to Problem

To solve the foregoing problem, a fuel injector according to an embodiment of the present invention includes a valve body having a valve body side seat surface, a valve seat side seat surface that abuts on the valve body side seat surface, and an injection hole provided downstream of a position at which the valve body side seat surface abuts on the valve seat side seat surface. The valve body has a projection that is formed from the valve body side seat surface toward the injection hole, and the projection is formed to be smaller in a direction of fuel flow between seats than a radius of an upstream opening surface of the injection hole.

Advantageous Effects of Invention

The present invention makes it possible to provide a fuel injector that is capable of reducing penetration of fuel spray. Other configurations, operations, and effects of the present invention will be described in detail in embodiments below.

DESCRIPTION OF EMBODIMENTS

Embodiments according to the present invention will now be described below.

Embodiment 1

A fuel injector and a controller thereof according to a first embodiment of the present invention will be described below with reference to FIGS. 1 to 11.

Figure 1:
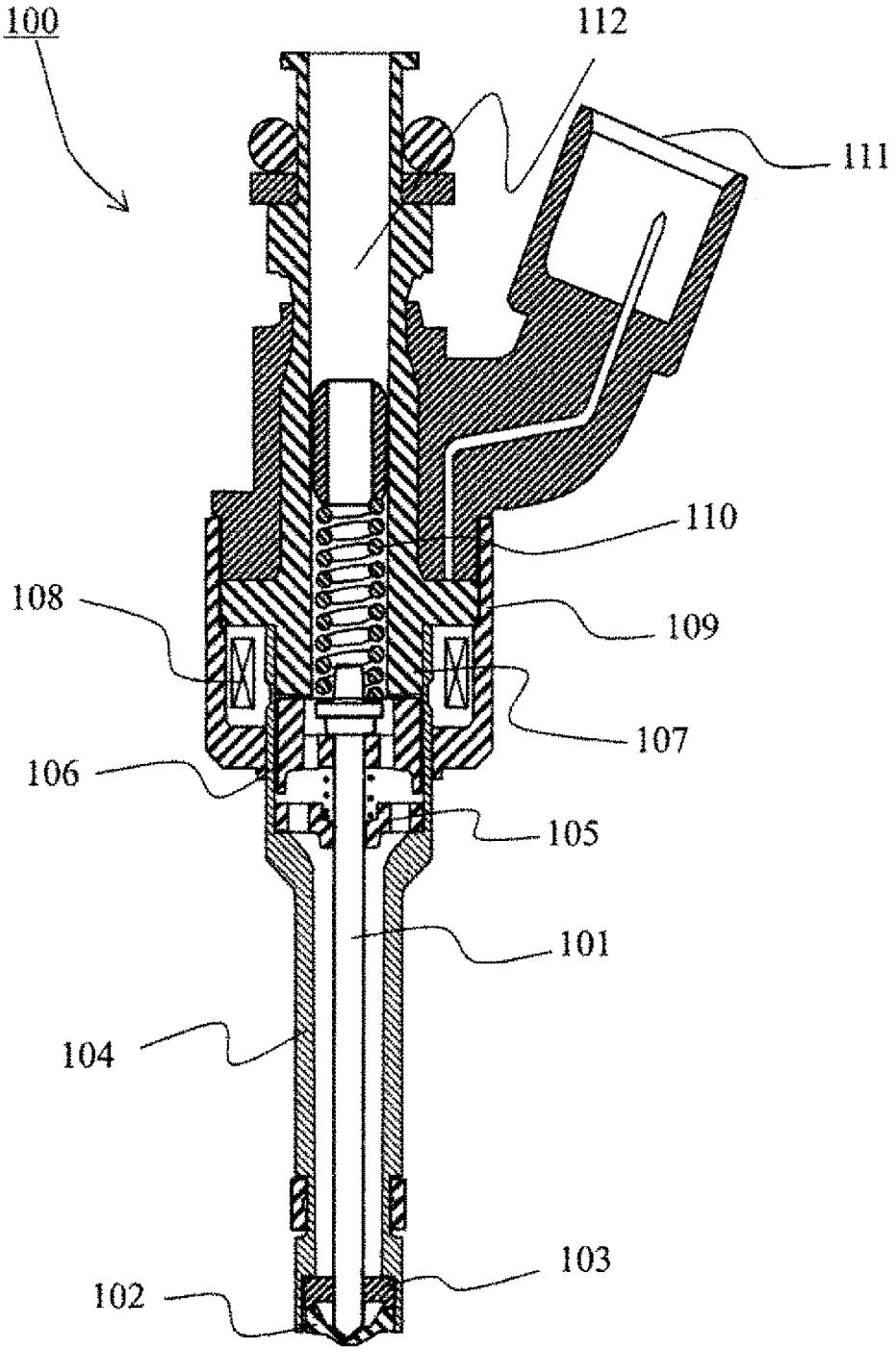
FIG. 1 is a cross-sectional view showing an embodiment of a fuel injector according to the present invention.

FIG. 1 is a cross-sectional view of the fuel injector (electromagnetic fuel injection valve) of this embodiment. Basic operations of the fuel injector are described with reference to FIG. 1. In FIG. 1, fuel is supplied from a fuel supply port 112 and supplied to an interior of a fuel injector 100. The fuel injector 100 shown in FIG. 1 is a normally-closed electromagnetic driven fuel injection valve. When a coil 108 is not energized, a valve body 101 is biased by a spring 110 and pressed against a seat member 102 that is joined to a nozzle body 104, such as by welding, so that the fuel flow is stopped. At this point, a fuel pressure supplied from a common rail to the cylinder injection fuel injector 100 such as this embodiment is in a range of about 1 MPa to 50 MPa.

When the coil 108 is energized through a connector 111 shown in FIG. 1, a magnetic flux density is generated in a core (stationary core) 107, a yoke 109, and an anchor 106, which constitute a magnetic circuit of the fuel injector 100, and a magnetic attraction is generated between the core 107 having a void and the anchor 106. When the magnetic attraction is greater than a sum of a biasing force of the spring 110 and a force supplied by the fuel pressure mentioned above, the valve body 101 is attracted toward the core 107 by the anchor 106 while being guided by a guide member 103 and a valve body guide 105, and opens.

When opened, a gap is formed between the seat member 102 and the valve body 101 and injection of the fuel begins. When the injection of the fuel begins, energy provided as the fuel pressure is converted into kinetic energy, reaches injection holes opened at a bottom end of the fuel injector 100, and is injected.

Figure 2:
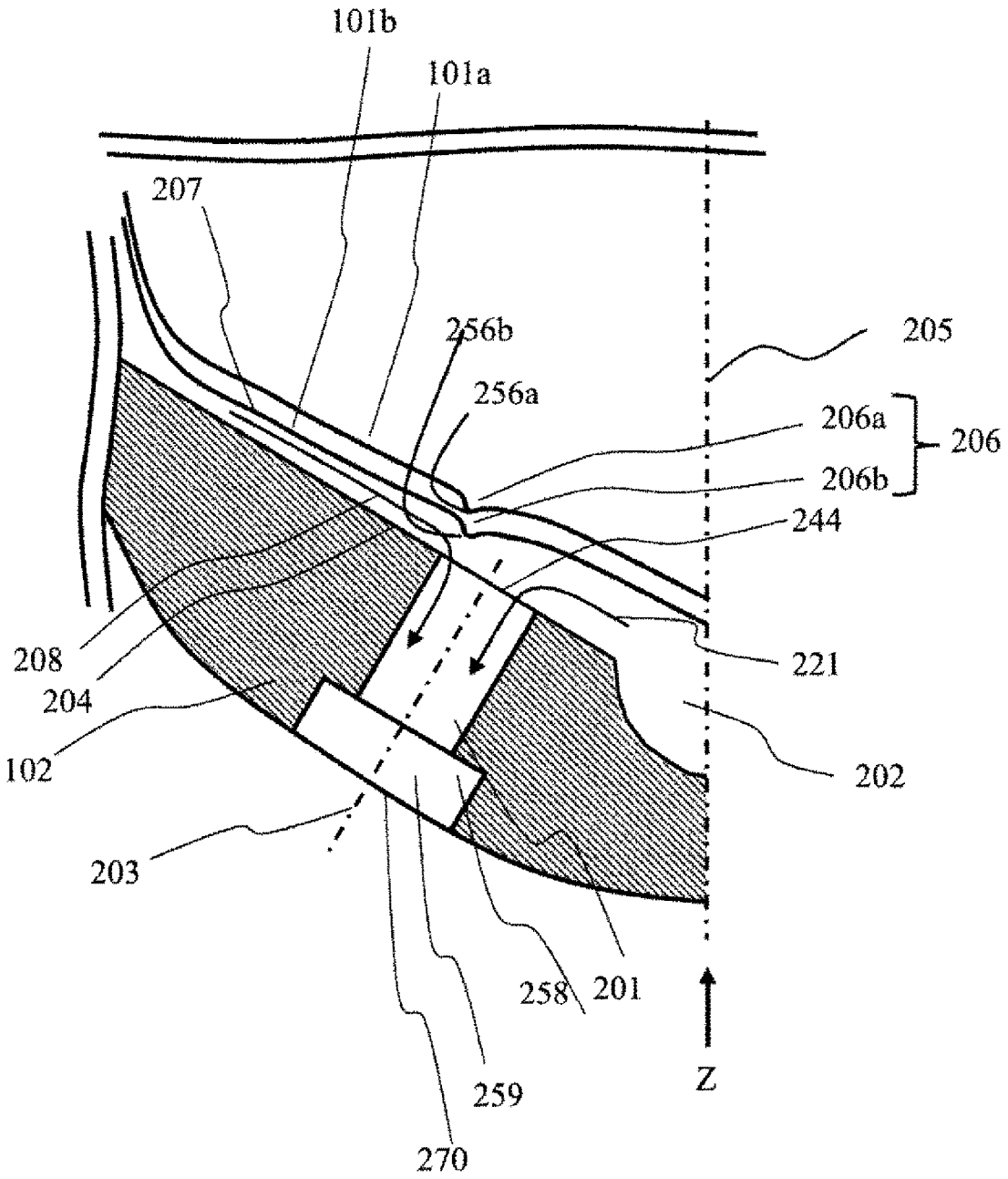
FIG. 2 is an enlarged cross-sectional view of the vicinity of a tip end of a valve body of a fuel injector according to a first embodiment of the present invention.

Next, the detailed shape of the valve body 101 is described with reference to FIG. 2. FIG. 2 is an enlarged cross-sectional view of the bottom end of the fuel injector 100, and includes the valve body 101 having a valve body side seat surface 207, a valve seat side seat surface 204 that abuts on the valve body side seat surface 207, and an injection hole 201 that is provided downstream of a position at which the valve body side seat surface 207 abuts on the valve seat side seat surface 204. The valve seat side seat surface 204 is formed on a valve body side end surface of the seat member 102. Although not shown, it should be noted that a plurality of the injection holes 201 are formed on the seat member 102 and that the plurality of the injection holes 201 are arranged on a circumference.

The valve seat side seat surface 204 and the valve body 101 are arranged axially symmetric about a valve body central axis 205. In the fuel injector 100, the fuel from upstream flows through a gap between the valve body side seat surface 207 and the valve seat side seat surface 204 as illustrated by arrow 208 in FIG. 2 and is injected from the injection hole 201. A portion of the fuel goes around into a sac chamber 202 distal to the injection hole and flows into the injection hole from the path of arrow 221. The valve body can be set to a large lift amount and a small lift amount, and the position of the valve body in the large lift amount is 101*a* and the position of the valve body in the small lift amount is 101*b*.

Figure 3:
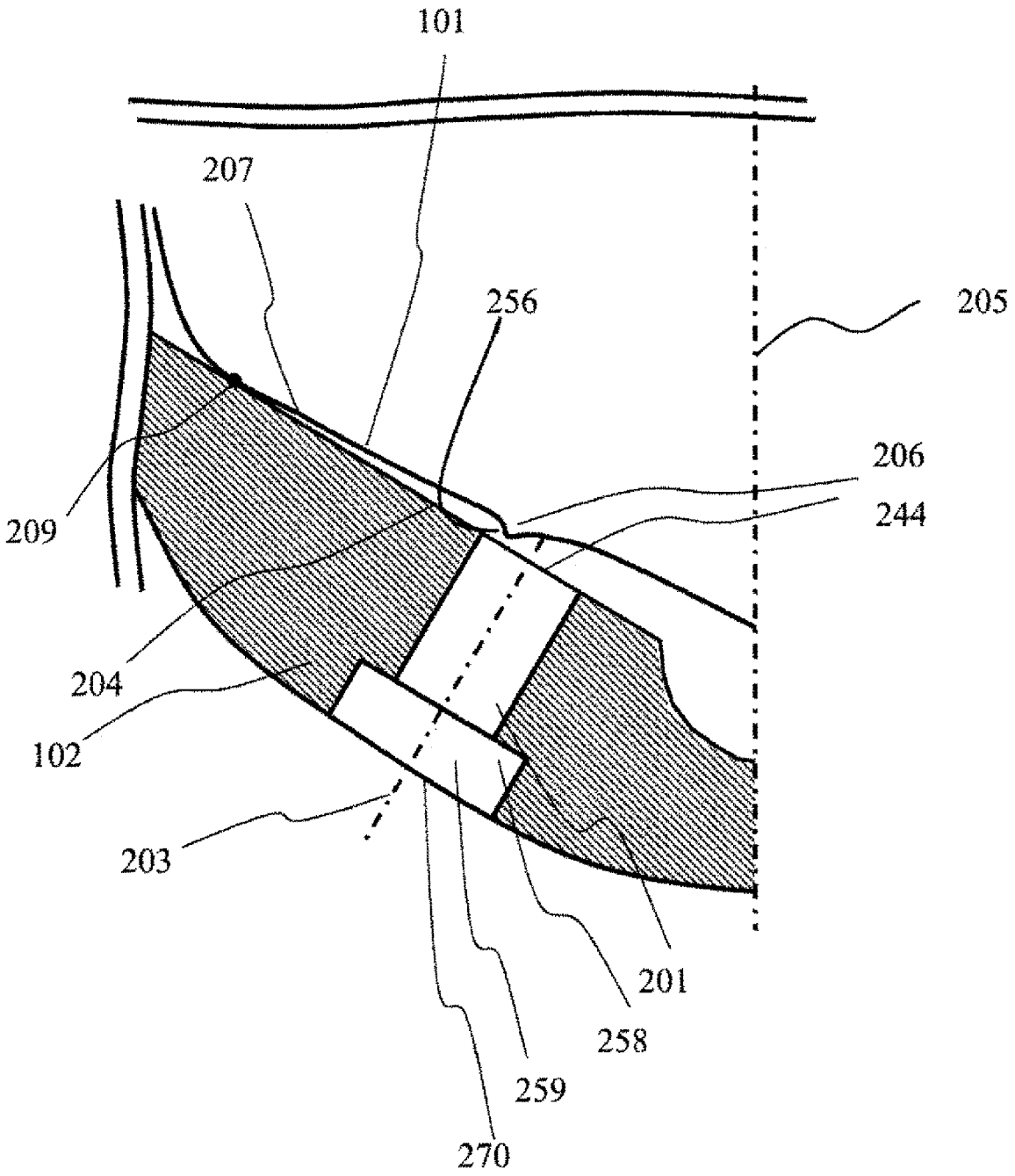
FIG. 3 is an enlarged cross-sectional view of the vicinity of the tip end of the valve body of the fuel injector according to the first embodiment of the present invention when the valve body is in a closed position.

A valve closed state of the fuel injector 100 is described with reference to FIG. 3. FIG. 3 is an enlarged cross-sectional view of the bottom end of the fuel injector 100, similar to FIG. 2. The valve body 101 is in line contact with the seat member 102 at a seat position 209 to stop the fuel flow from upstream in the fuel injector 100. At this point, a tip 256 of a guide portion 206 that is formed toward the injection hole 201 from the valve body side seat surface 207 is prevented from coming into contact with the seat member 102. The fuel flow is thus stopped at the seat position 209.

Figure 4:
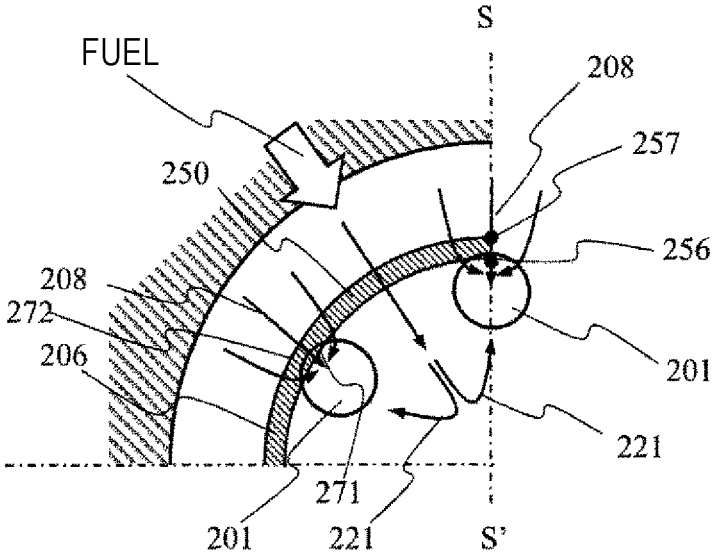
FIG. 4 is a view on the arrow of FIG. 2 to illustrate a fuel flow according to the first embodiment of the present invention.
Figure 4:
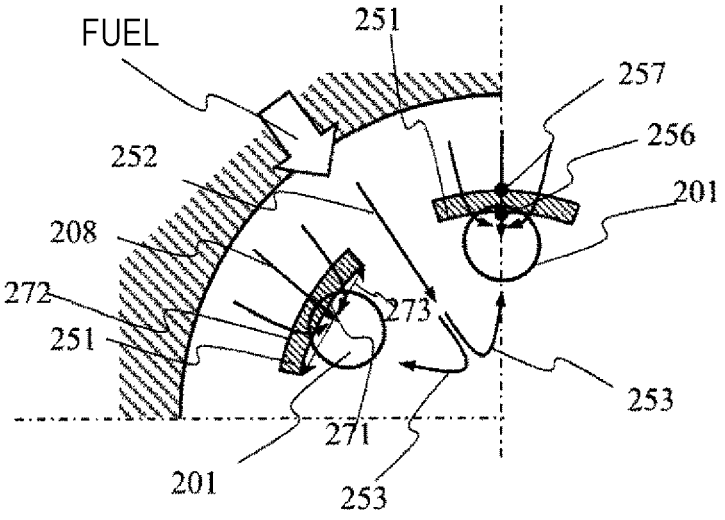

FIG. 4(*a*) is a view on arrow Z of FIG. 2. It should be noted that FIG. 2 is an S-S' cross-sectional view of FIG. 4(*a*). In this embodiment, as shown in FIGS. 2 and 4(*a*), the guide portion 206 that is formed from the valve body side seat surface 207 toward the injection hole 201 is formed on the conically shaped valve body side seat surface 207 of the valve body 101. As shown in FIG. 4(*a*), an area 250 having a smaller cross section is annularly formed by the guide portion 206. In FIG. 4(*a*), the guide portion 206 is formed from an upstream end surface 272 toward a downstream end surface 271, and this area is shown shaded. End portions of the upstream end surface 272 and the downstream end surface 271 that correspond to the injection hole 201 are referred to as an upstream end portion 257 and a downstream end portion 256. The guide portion 206 is a projection that is formed on the valve body 101 to project from the valve body side seat surface 207 toward the injection hole 201. Alternatively, it may be called a step.

Figure 5:
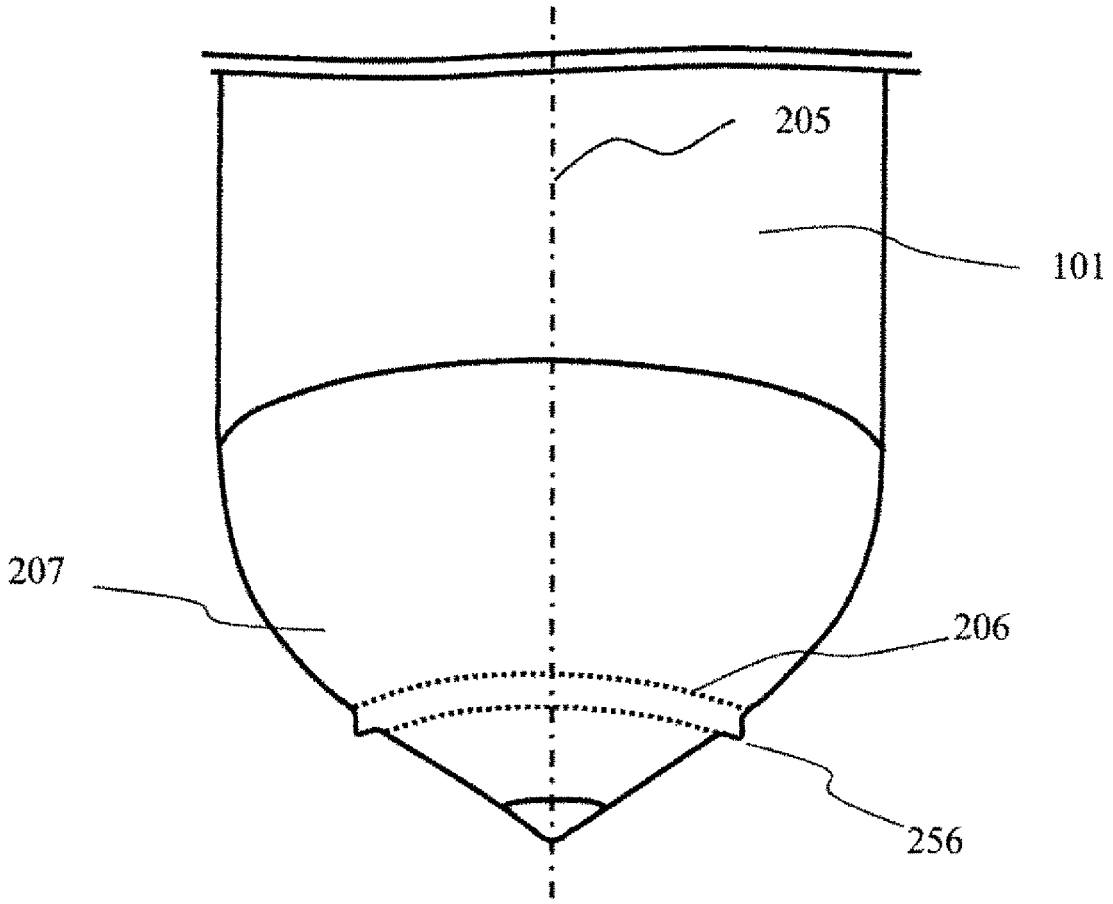
FIG. 5 is a perspective view of the valve body of the fuel injector according to the first embodiment of the present invention.

FIG. 5 is a perspective view of a tip end shape of the valve body 101. In this embodiment, the valve body side seat surface 207 has a spherical surface. The shaded guide portion 206 is formed annularly about the central axis 205 of the valve body 101, and a tip portion 256 of the guide portion 206 is also formed annularly. It should be noted that the annular guide portion 206 is provided during the process of cutting the valve body 101.

Figure 6:
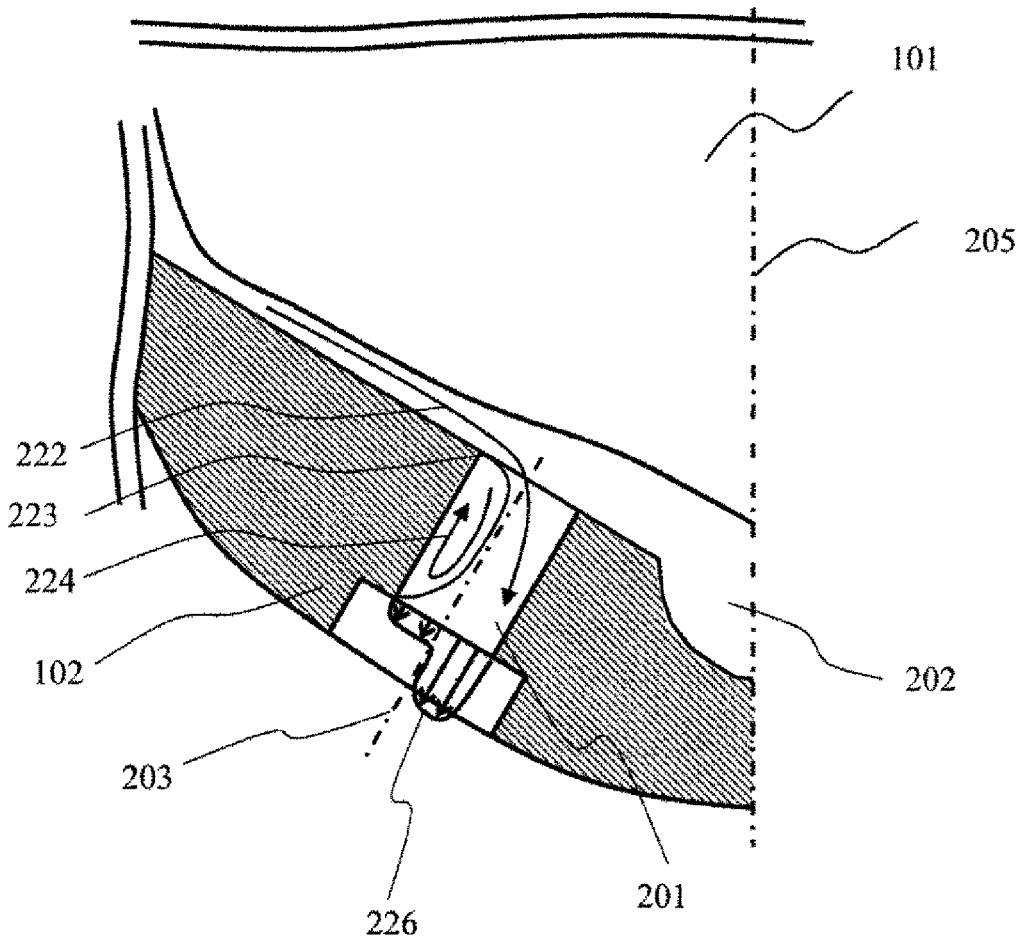
FIG. 6 is an enlarged cross-sectional view of the vicinity of a tip end of a valve body of a conventional fuel injector for comparison to the first embodiment of the present invention.

To describe the effect of a projection 206 on penetration, the flow of the fuel and velocity distribution at an injection hole outlet in the small lift amount in a configuration in which the valve body does not have a projection is first described with reference to FIG. 6. In the configuration of FIG. 6, when a fuel flow flows into the injection hole 201, the fuel flow separates from an injection hole edge 223 of an injection hole inlet and flows into a downstream side inside the injection hole 201 along a path of arrow 222. A separation vortex 224 is then formed in an upstream side inside the injection hole 201 and the flow of the fuel is pressed against a wall on the downstream side inside the injection hole 201. As a result, in an injection hole outlet plane, a velocity distribution having a region with greater velocity on the downstream side inside the injection hole 201 is formed such as a velocity distribution 226. The velocity distribution 226 represents the magnitude of velocity at start points of arrows by the lengths of the arrows. In the configuration of FIG. 6, at the injection hole outlet, there appears a region with smaller velocity (low velocity region) represented by short arrows and a region with greater velocity (high velocity region) represented by long arrows.

Figure 7:
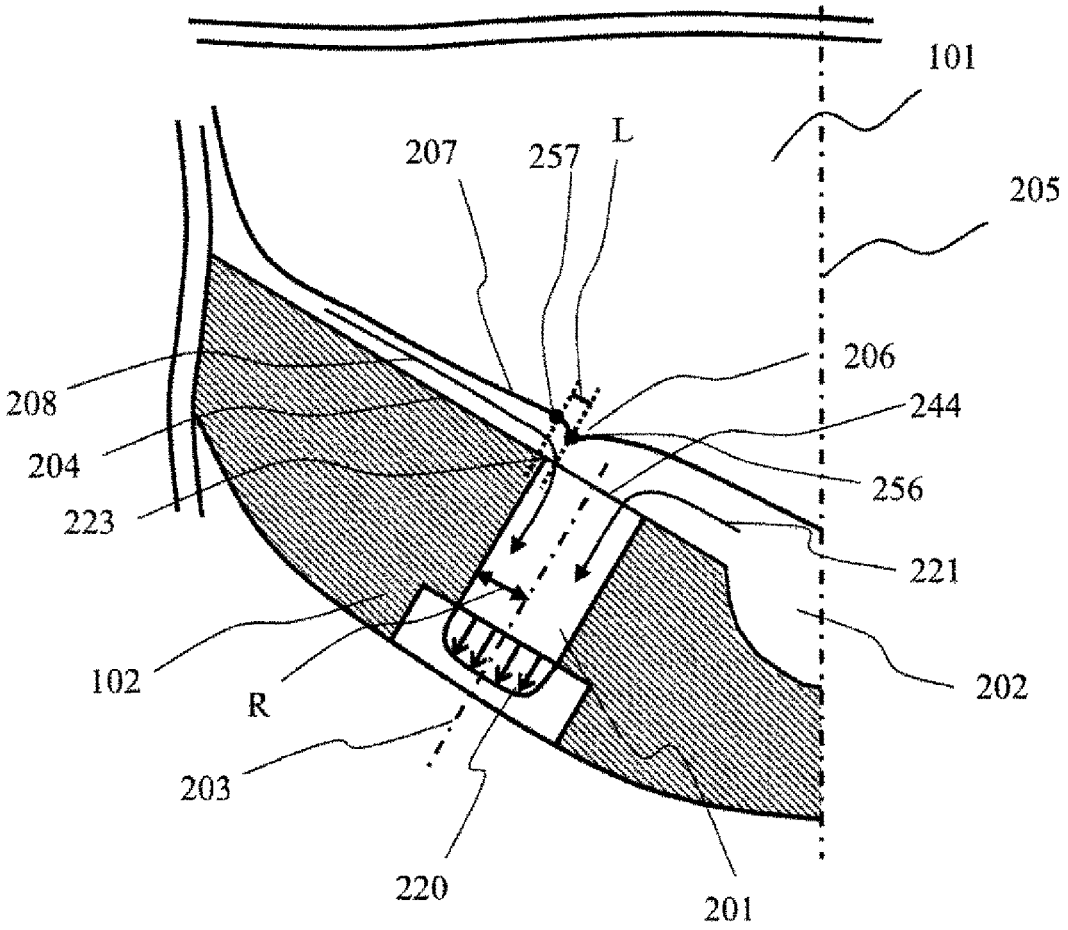
FIG. 7 is a diagram showing a velocity distribution at an injection hole outlet of the fuel injector according to the first embodiment of the present invention.

Next, the flow of the fuel and the velocity distribution at the injection hole outlet in the small lift amount according to this embodiment is described with reference to FIG. 7. As shown in FIG. 7, in this embodiment, a dimension L of the projection 206 in a direction of fuel flow between the seats is formed smaller than a radius R of an upstream opening surface 244 of the injection hole 201. More specifically, in a position corresponding to the injection hole 201, the upstream end portion 257 of the projection 206 is located upstream of an upstream end portion (injection hole edge 223) of the upstream opening surface 244 of the injection hole 201. Additionally, the downstream end portion 256 of the projection 206 is formed to be located between the upstream end portion (injection hole edge 223) of the upstream opening surface 244 of the injection hole 201 and the center of the upstream opening surface 244.

The projection 206 is thus capable of guiding the fuel from upstream of the injection hole edge 223 by a predetermined guide angle and changing the direction of flow to cause the fuel to flow downstream of the injection hole edge 223. Consequently, the flow of the fuel goes around the injection hole edge 223 so that the fuel flows into the upstream side inside the injection hole 201. As a result, a local bias in the magnitude of velocity in a velocity distribution 220 at the injection hole outlet is reduced. This makes the velocity distribution in the injection hole outlet plane uniform compared to the velocity distribution 226 in FIG. 6 and enables the velocity distribution to be flattened out. The direction of flow changes from a start position (upstream end portion 257) of the projection 206 up to a distal most portion (downstream end portion 256) of the projection 206, and the change in the direction of flow is in a range of length L.

Two regions are defined here: an upstream side (upstream side inside the injection hole) and a downstream side (downstream side inside the injection hole) of an injection hole axis 203, which is the central axis of the injection hole 201, in a flow path at the injection hole inlet. It should be noted that the injection hole axis 203 is formed by a straight line connecting the center of the upstream opening surface 244 with the center of the downstream opening surface 258. A counterbore is formed in the injection hole 201 of this embodiment, and for the injection hole axis 203, a counterbore downstream opening surface 270 may be used instead of the downstream opening surface 258. To cause the fuel to flow toward the upstream side inside the injection hole, it is required that an effect range is included in the upstream side inside the injection hole. Thus, in this embodiment, the dimension L of the projection in the direction of fuel flow between the seats is made smaller than the radial length R which is the size of the injection hole inlet of the upstream side inside the injection hole. Consequently, the fuel flows into the upstream side inside the injection hole 201, making it possible for the fuel to flow into the upstream side inside the injection hole.

Figure 8:
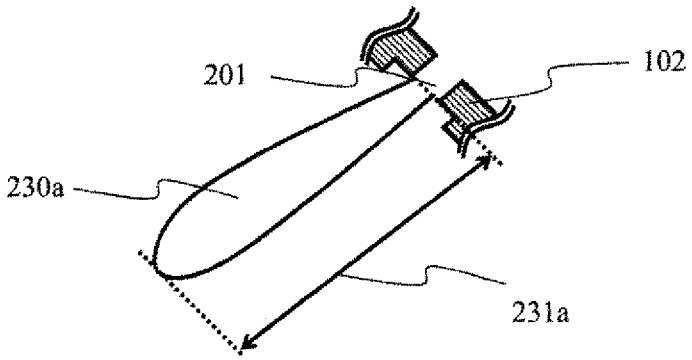
FIG. 8 is a diagram illustrating the shapes of spray formed using the fuel injector according to the first embodiment of the present invention.
Figure 8:
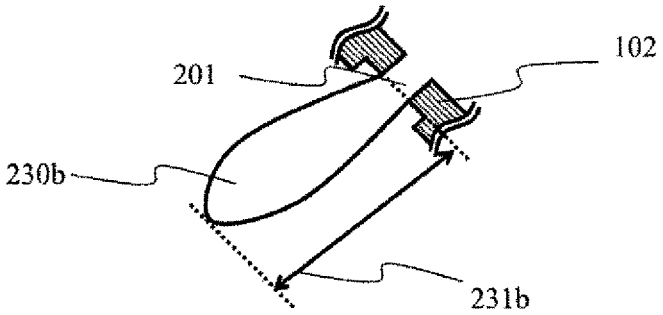

The effect on penetration of flattening out the velocity distribution in the injection hole outlet plane will now be described with reference to FIG. 8. FIG. 8(*a*) shows an example of a spray shape 230*a* injected from the injection hole and a penetration length 231*a* thereof in the configuration of FIG. 6 having no projections. FIG. 8(*b*) shows an example of a spray shape 230*b* injected from the injection hole 201 and a penetration length 231*b* thereof in FIG. 7. The greater the maximum velocity in the injection hole outlet plane, the greater the penetration length will be. Thus, the penetration is greater in the case in which the velocity distribution has a locally high velocity region such as in the configuration of FIG. 6.

In contrast, in the velocity distribution 220 in this embodiment shown in FIG. 7, the velocity is flattened out within the plane and there is no locally high velocity region, so that the penetration is shorter. Furthermore, since this embodiment improves the velocity of the fuel by the projection 206, cavitation can be caused by suitably selecting various conditions such as fuel injection pressure and fuel temperature to thereby further reduce the penetration.

Figure 9:
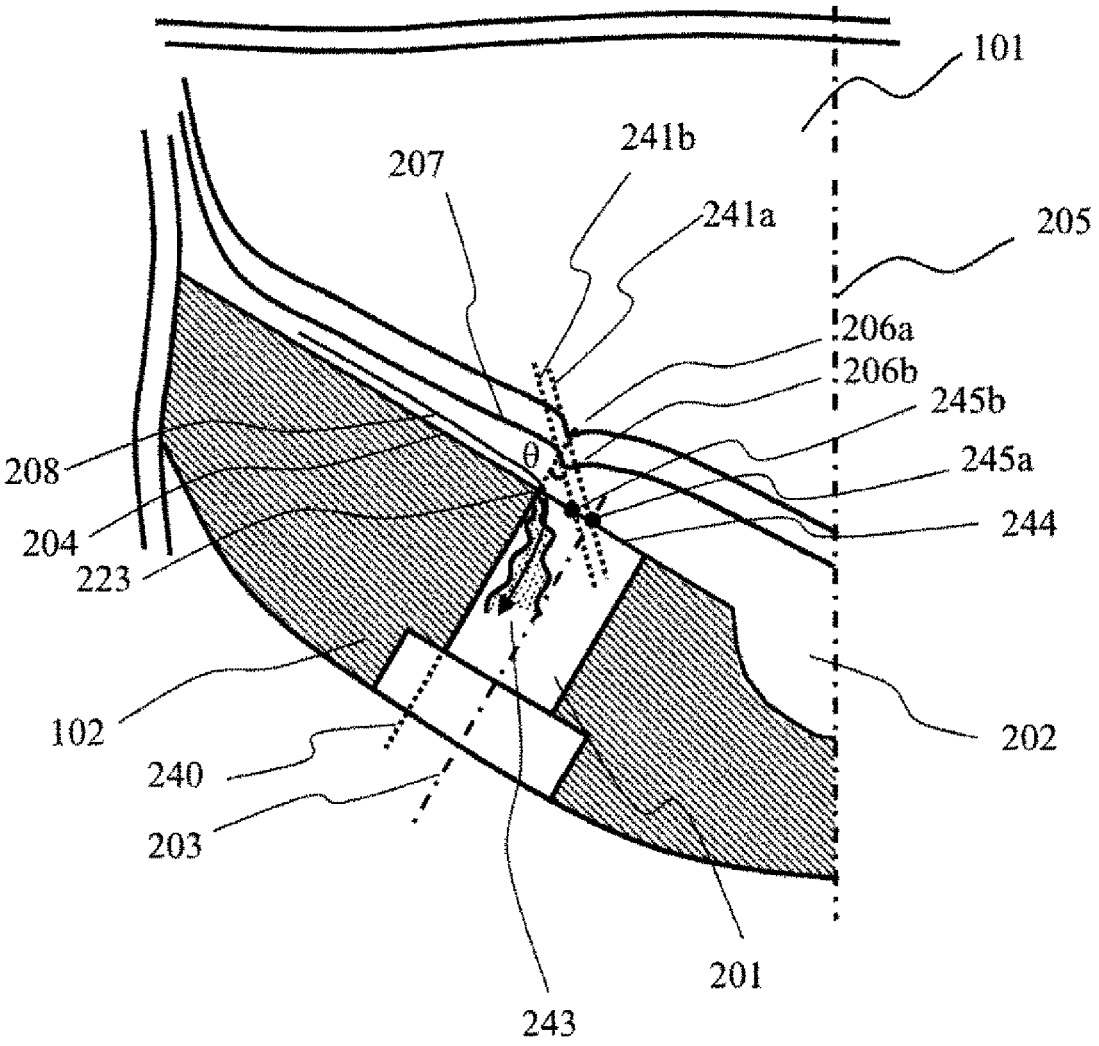
FIG. 9 is a diagram showing an occurrence of cavitation in the injection hole of the fuel injector according to the first embodiment of the present invention.

Next, the mechanism of the occurrence of cavitation in this embodiment and effects thereof are described with reference to FIG. 9. FIG. 9 shows how cavitation 243 occurs at the injection hole inlet edge 223. In FIG. 9, a guide inclination angle θ is formed between a straight line 240 that extends along an inner wall on the upstream side inside the injection hole 201 and a tangent line 241*a* of a projection 206*a* or a tangent line 241*b* of a projection 206*b*. Alternatively, the guide inclination angle θ may be defined as an angle formed between the injection hole axis 203 and a tangent line 241 of the projection 206 (206*a* or 206*b*). In a case in which the projection 206 has a curved surface, for the tangent line 241, the tangent line that forms a smallest guide inclination angle θ with the straight line 240 of the tangent lines of the projection 206 is the tangent line that contributes to the change in the direction of flow. When the guide inclination angle $\theta=0°$, the injection hole axis 203 and the tangent line 241 of the projection 206 (206*a* or 206*b*) are parallel. In this embodiment, the guide inclination angle θ is set to a small angle and is, for example, $0°<\theta<90°$.

Thus, the flow near the injection hole edge 223 is guided by the projection 206 to curve suddenly, so that the surrounding pressure is greatly reduced. The change in the direction of flow due to the projection 206 causes the fuel to flow into the injection hole 201 through the flow path of arrow 208. This causes separation that occurs near the injection hole edge 223 to be small and the flow to curve suddenly near the injection hole edge 223, thereby significantly reducing the pressure in the vicinity. When local pressure drops below the saturated vapor pressure of the fuel, the cavitation 243 occurs. The cavitation 243 promotes disturbance inside the injection hole and atomizes the fuel spray. The atomization of the fuel spray promotes dispersion of droplets and reduces the penetration of the fuel spray.

For example, with the guide inclination angle θ between the tangent line 241*b* of the projection 206*b* in the small lift amount and the injection hole axis 203 being $0° < \theta < 90°$, cavitation is caused and the penetration of the fuel spray is further reduced.

To suitably change the direction of flow, the projection 206 is preferably located near the injection hole edge 223 and downstream of the injection hole edge 223. Specifically, in a position corresponding to the injection hole 201, of the tangent lines 241 formed upstream of a downstream end portion A of the projection 206, the tangent line 241 that forms a smallest angle with the injection hole axis 203 of the injection hole 201 is formed to intersect an upstream side of the upstream opening surface 244 of the injection hole 201.

Figure 10:
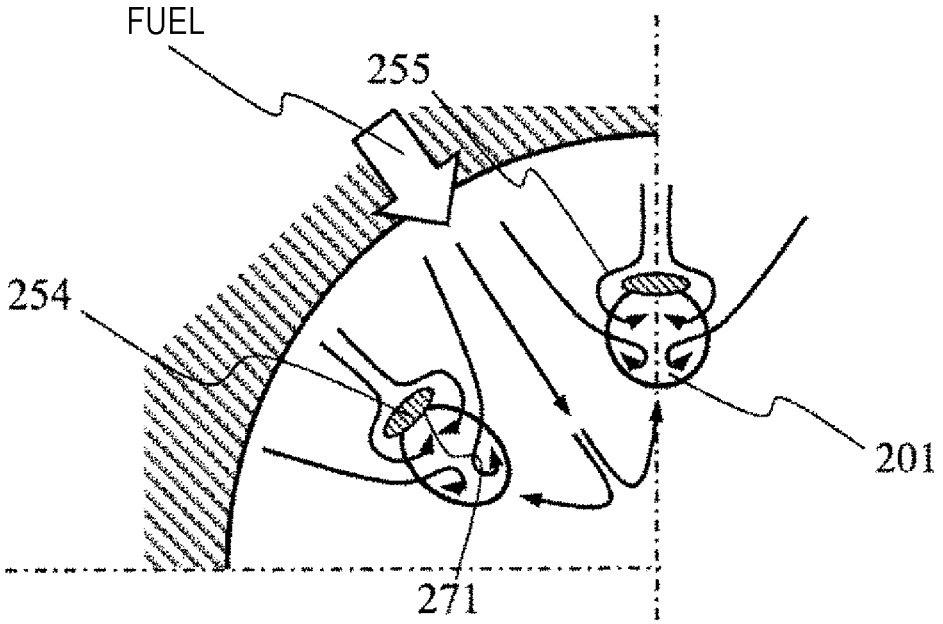
FIG. 10 is a view as in FIG. 4 to illustrate a fuel flow according to the configuration of FIG. 6.

For comparison against this embodiment, a case in which a protrusion 254 is provided upstream of the injection hole 201 is described with reference to FIG. 10. The protrusion 254 is formed in a spherical shape protruding from the valve body side seat surface 207 toward the injection hole 201, and this spherically shaped protrusion 254 is formed corresponding to each injection hole 201. The protrusion 254 is spherically shaped, so that the downstream end surface 271 of the protrusion 254 in FIG. 10 is formed to have, in a longitudinal direction, a height from the valve body side seat surface 207 that is lowest at one end, high in the center, and lowest again at the other end.

The protrusion 254 functions to suppress the flow of fuel from upstream, and arrows 255 indicate the fuel flow that flows into the injection hole 201. Producing a flow that bypasses a flow suppressing portion 254 gives a swirl direction velocity component to the flow that flows into the injection hole 201. However, in general, in a velocity field inside the injection hole, a velocity component in an injection hole axial direction is relatively much greater than the swirl direction velocity component. Thus, in the method described in FIG. 10 that utilizes a swirl flow, the effect of reducing the penetration would be limited.

In contrast, the shape of this embodiment shown in FIG. 4 is such that the downstream end surface 271 of the guide portion (projection 206) is formed to have a height from the valve body side seat surface 207, the height being substantially the same in a region larger than a diameter (2×R) of the upstream opening surface 244 of the injection hole 201. Specifically, as shown in FIG. 4(*a*), the projection 206 is formed annularly on the valve body side seat surface 207 of the valve body 101 and thus is formed such that the height (projecting length) from the valve body side seat surface 207 is substantially constant. Alternatively, as shown in FIG. 4(*b*), projections 251 are formed individually but are not formed in positions that do not correspond to the injection holes 201. Alternatively, an annularly formed projection 251 may be provided with notches in the positions that do not correspond to the injection holes 201. A straight line on the downstream side of each projection 251 in FIG. 4(*b*) that connects one end with the other end thereof is referred to as a guide region 273.

In this embodiment, this guide region is much larger than the diameter (2×R) of the upstream opening surface 244 and is formed such that the height (projecting length) from the valve body side seat surface 207 is substantially constant across the entire guide region. Thus, as shown in FIG. 10, generation of the swirl flow is suppressed. Additionally, in this embodiment, the downstream end portion 256 of the projection 206 formed in the guide region in the position that corresponds to the injection hole 201 is located upstream of the center of the upstream opening surface 244 of the injection hole 201. Thus, the velocity distribution in the injection hole outlet plane can be flattened out to enable the maximum velocity in the axial direction to be suppressed, and the penetration is reduced effectively.

Furthermore, in the method described in FIG. 10, the flow bypasses the flow suppressing portion 254 so that the swirl flow changes significantly due to the relationship between the position of the flow suppressing portion 254 and the position of the injection hole. Machining thus requires critical positioning accuracy and deviations from machining errors may be large. In contrast, the configuration of FIG. 4(*a*) or (*b*) described above of this embodiment is capable of directly guiding the fuel flow from upstream into the injection hole, so that the effect is not easily affected by machining errors or axial rotations of the valve body.

Figure 11:
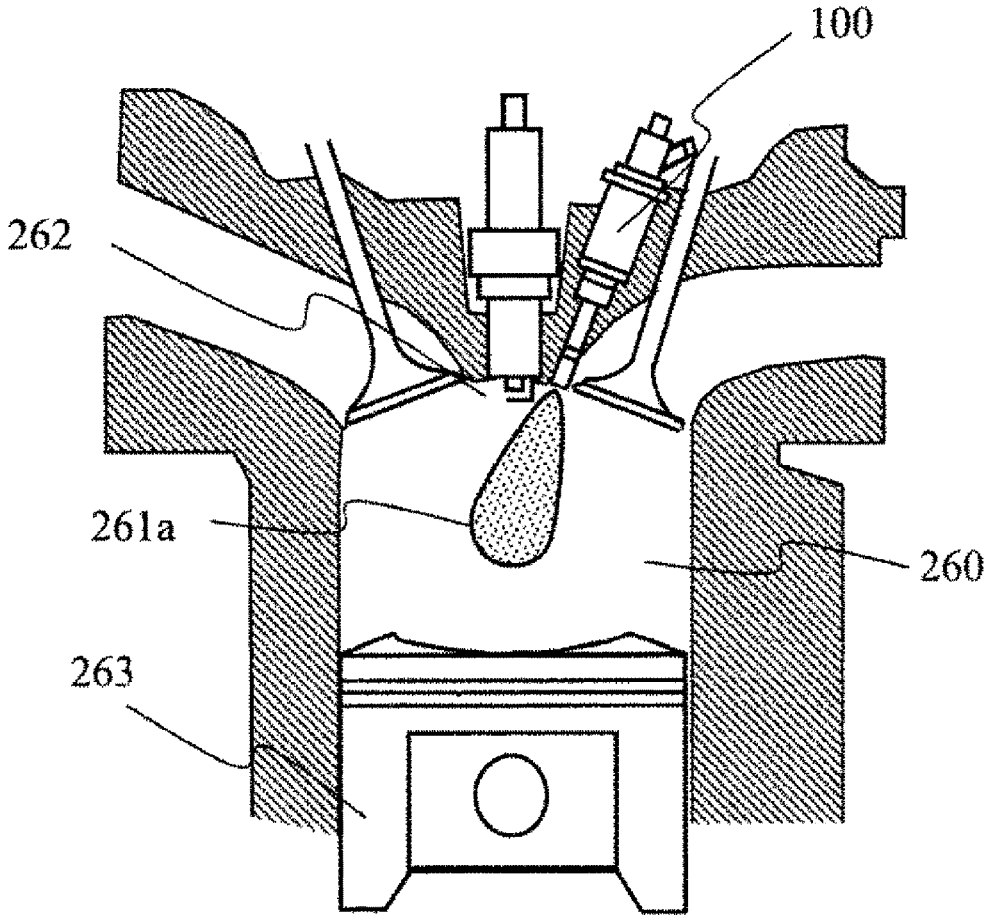
FIG. 11 is a diagram illustrating a combustion chamber of an engine configured with the fuel injector according to the first embodiment of the present invention.

Next, a method for controlling the fuel injector of this embodiment is described with reference to FIG. 11. FIG. 11 is a diagram showing a combustion chamber of an internal combustion engine for vehicles. The fuel injector 100 injects the fuel into a combustion chamber 260 to form an air fuel mixture. The air fuel mixture inside the combustion chamber 260 is ignited by spark ignition by a spark plug 262 for combustion.

In this embodiment, the behavior of a piston 263 is determined by a speed of the engine. When the speed of the engine is low, air flow inside the combustion chamber 260 is slow and the fuel tends to adhere to a wall of the combustion chamber and the piston. Since it is desirable, at this time, that the penetration is reduced, the lift amount is controlled to be small. Conversely, when the speed of the engine is high, the air flow inside the combustion chamber 260 is active, so that generation of the air fuel mixture is promoted. Since it is desirable, at this time, that the penetration is increased to promote the generation of the air fuel mixture by the air flow, the lift amount is controlled to be large.

That is, the valve body 101 is controlled by at least two lift amounts of the small lift amount and the large lift amount. As shown in FIGS. 2 and 9, when the valve body 101*b* opens by the small lift amount, of the tangent lines formed upstream of a downstream end portion 256*b* of the projection 206*b*, the tangent line 241*b* that forms the smallest angle with the injection hole axis 203 of the injection hole 201 is configured to intersect with the upstream side of the upstream opening surface 244 of the injection hole 201. When the valve body 101*a* opens by the large lift amount, the tangent line 241*a* that forms the smallest angle with the injection hole axis 203 of the injection hole 201 is configured to intersect with a downstream side of the upstream opening surface 244 of the injection hole 201.

It is also possible to control the lift amount by an air-fuel ratio in the combustion chamber 260. When the air-fuel ratio is less than a predetermined value, combustion is lean and thus, it is desirable to create a rich air-fuel ratio condition around the spark plug so that ignition occurs easily. Since it is desirable, at this time, that the penetration is reduced, the lift amount is controlled to be small. Conversely, when the air-fuel ratio in the combustion chamber 260 is greater than the predetermined value, it is desirable to create a uniform air fuel mixture inside the combustion chamber 260 so that combustion occurs throughout the combustion chamber. Since it is desirable, at this time, that the penetration is increased to generate the air fuel mixture throughout the combustion chamber, the lift amount is controlled to be large.

It also possible to control the lift amount by a coolant temperature or an oil temperature. When the coolant temperature or the oil temperature of the engine is lower than a predetermined temperature, the low temperature inhibits complete combustion, thereby increasing emission of PM and unburned hydrocarbons. The lift amount is controlled to be small at this time to reduce the penetration and suppress adhesion to the wall as much as possible.

Furthermore, the lift amount may be controlled by the position of the piston 263. When a distance between the piston 263 and the fuel injector 100 during a fuel injection period is shorter than a predetermined distance, the lift amount is controlled to be small to prevent adhesion of the fuel to the piston. When the distance between the piston 263 and the fuel injector 100 during a fuel injection period is longer than the predetermined distance, the lift amount is controlled to be large to promote dispersion of the fuel.

It should be noted that the control method shown in this embodiment may be utilized for short pulse injection or for multiple injection that uses the short pulse injection. Since the lift amount is small in the short pulse injection, the lift amount can be controlled by the air-fuel ratio, the coolant temperature or the oil temperature, or the position of the piston. Since the volume of injection per pulse is reduced in the short pulse injection, a required fuel quantity can be injected by multiple injection. The lift amount can also be controlled by the above means for multiple injection.

Embodiment 2

Figure 12:
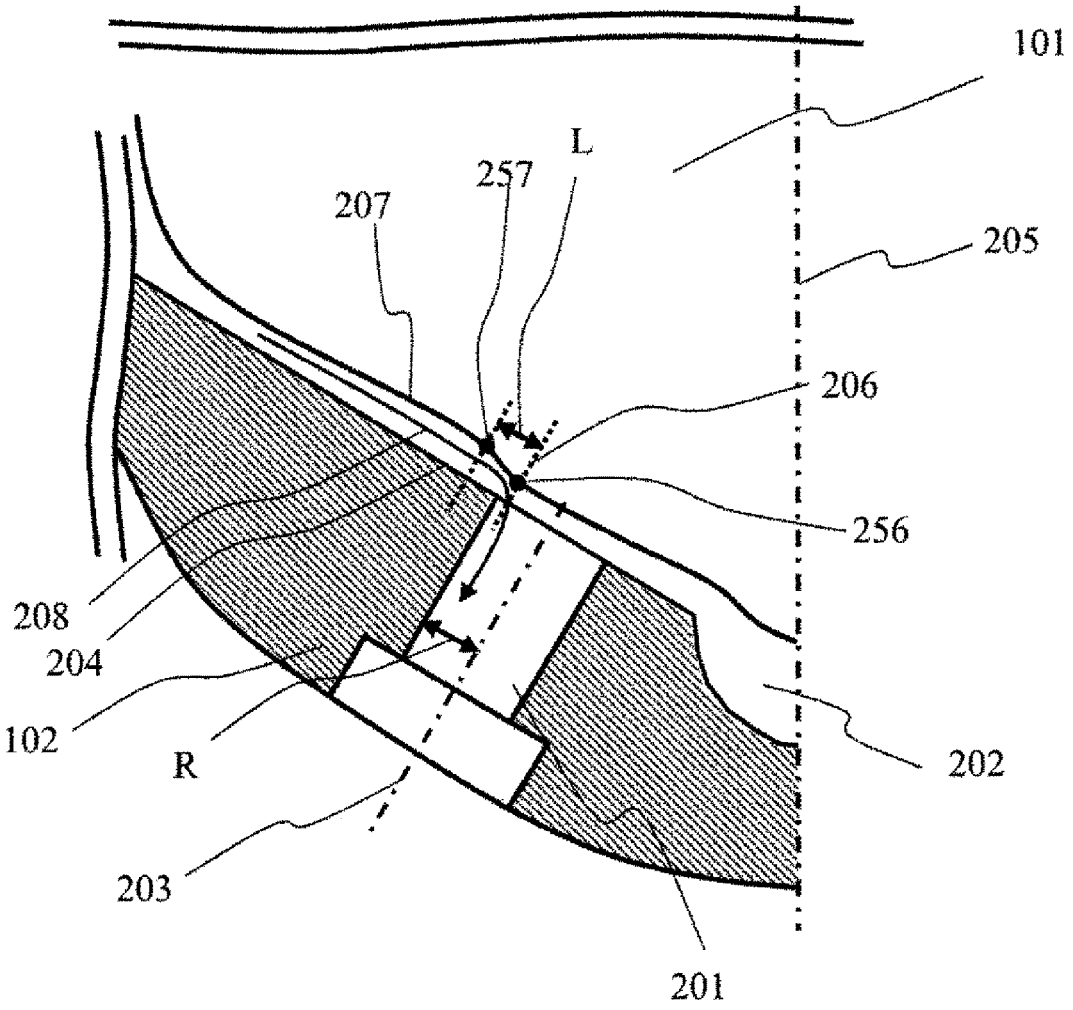
FIG. 12 is an enlarged cross-sectional view of the vicinity of a tip end of a valve body of a fuel injector according to a second embodiment of the present invention.

A fuel injector according to a second embodiment of the present invention will be described below with reference to FIG. 12. In the second embodiment shown in FIG. 12, the projection 206 is formed such that the flow path narrows from the upstream end portion 257, which is the start position of the projection 206, toward the downstream end portion 256, which is a lower end position thereof. In Embodiment 1, the projection 206 is configured to extend, between the upstream end portion 257 and the downstream end portion 256, from the valve body side seat surface 207 toward the injection hole 201. In contrast, in this embodiment, the projection 206 is configured such that the flow path does not expand downstream of the downstream end portion 256. That is, the projection 206 is configured to extend, between the upstream end portion 257 and the downstream end portion 256, from the valve body side seat surface 207 toward the injection hole 201. Then, further downstream of the downstream end portion 256, the valve body side seat surface 207 is configured to run parallel to the valve seat side seat surface 204. The projection 206 may be configured as a cone. Other configurations are the same as those of Embodiment 1.

Embodiment 3

Figure 13:
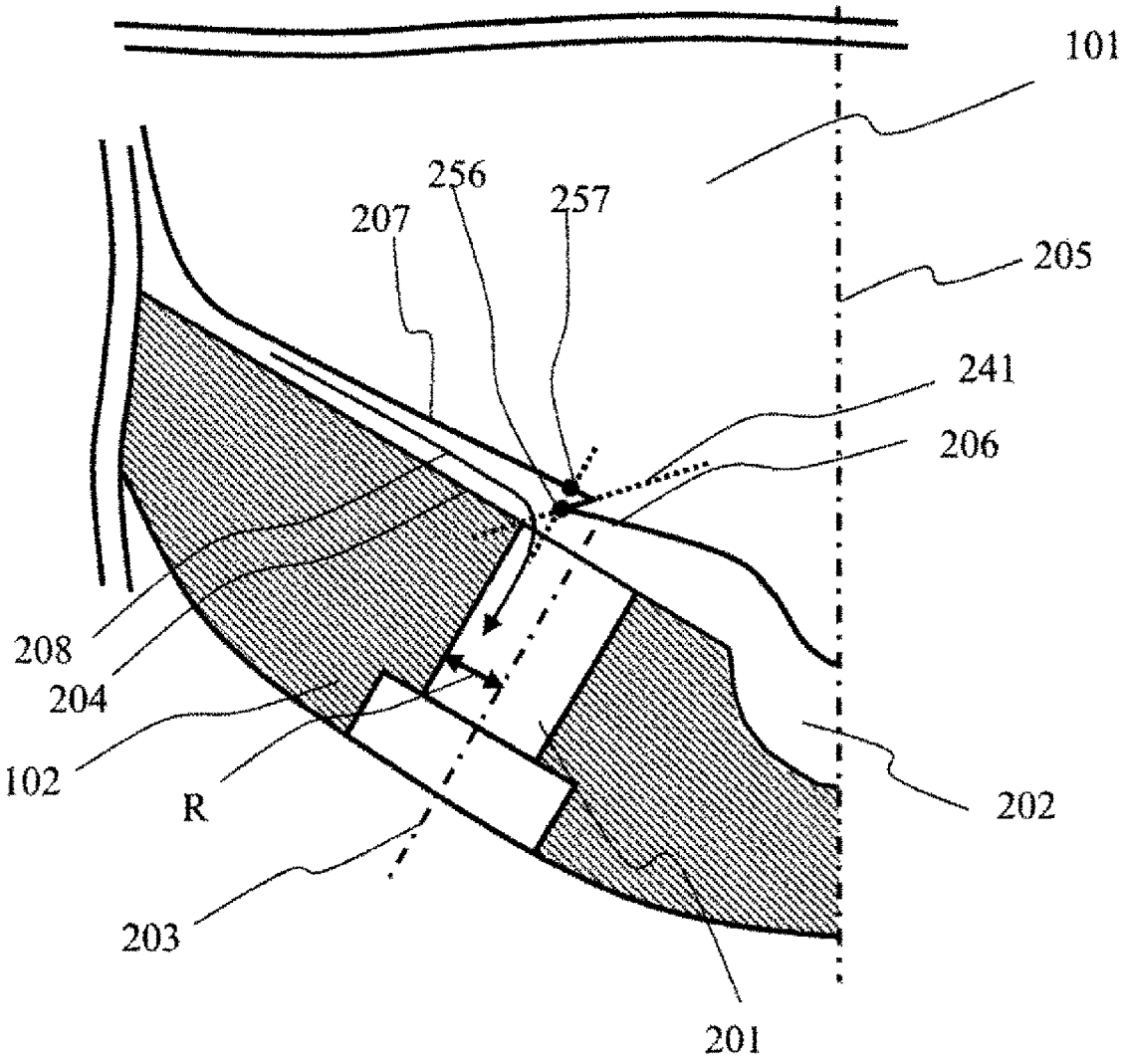
FIG. 13 is an enlarged cross-sectional view of the vicinity of a tip end of a valve body of a fuel injector according to a third embodiment of the present invention.
Figure 14:
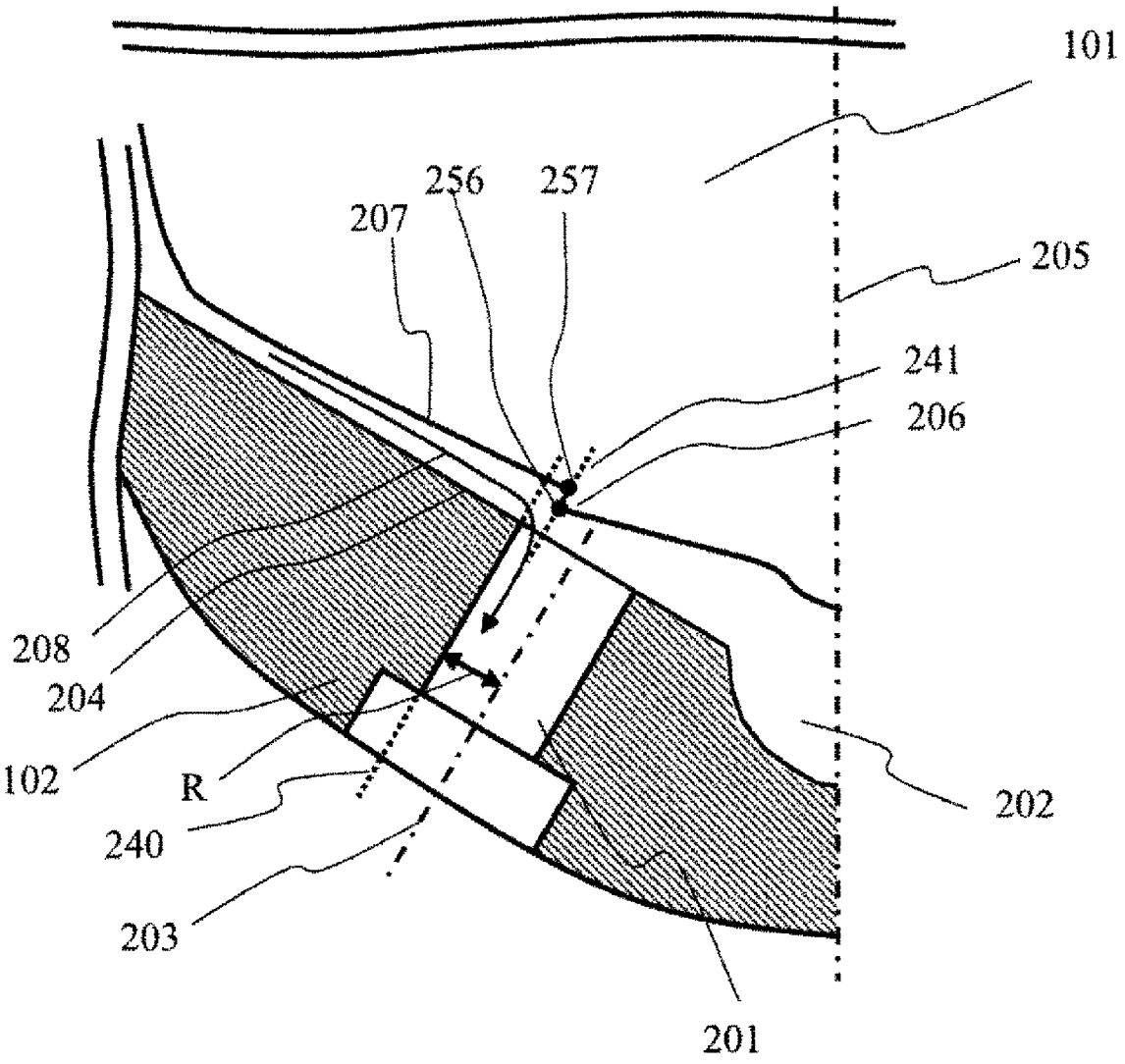
FIG. 14 is an enlarged cross-sectional view of the vicinity of the tip end of the valve body of the fuel injector according to the third embodiment of the present invention.

A fuel injector according to a third embodiment of the present invention will be described below with reference to FIG. 13. In this embodiment, the projection 206 is formed from the upstream end portion 257, which is the start position of the projection 206, toward the downstream end portion 256, which is the lower end position thereof, and the tangent line 241 of the projection 206 faces upstream of the flow path. The flow is blocked by the projection 206 so that the direction of flow toward the injection hole is changed. As a result, the flow is guided upstream inside the injection hole and similar effects to those seen in Embodiment 1 are obtained. As shown in FIG. 14, the tangent line 241 of the projection 206 may be horizontal with the straight line 240 that extends along the inner wall on the upstream side inside the injection hole 201. Other configurations are the same as those of Embodiment 1.

REFERENCE SIGNS LIST

100 fuel injector
101 valve body
102 seat member
104 nozzle body
108 coil
110 spring
201 injection hole
202 sac chamber
203 injection hole axis which is the central axis of injection hole
204 valve seat side seat surface
206 projection (guide portion)
207 valve body side seat surface 207
233 injection hole edge
241 tangent line formed by projection (guide portion)
244 upstream opening surface of injection hole
256 downstream end portion
257 upstream end portion
258 downstream opening surface of injection hole
271 downstream end surface 271
272 upstream end surface

The invention claimed is:

1. A fuel injector for injection of fuel, comprising:

a valve body having a valve body side seat surface;

a valve seat side seat surface that abuts on the valve body side seat surface; and an injection hole provided downstream of a position at which the valve body side seat surface abuts on the valve seat side seat surface, wherein:

a projection is formed on the valve body to project from the valve body side seat surface toward the injection hole, a distance, in a direction of fuel flow between the valve body side seat surface and the valve seat side seat surface, between a first portion of the projection and a second portion of the projection at which the projection is closest to the injection hole, is smaller than a radius of an opening of the injection hole at an upstream surface of the injection hole, the valve body is configured to be selectively lifted by one of at least two lift amounts comprising a first lift amount and a second lift amount, the first lift amount being smaller than the second lift amount, such that:

when the valve body opens by the first lift amount, of a plurality of tangent lines formed upstream of the second portion of the projection, a tangent line forming a smallest angle with an injection hole axis of the injection hole intersects with an upstream side of the opening of the injection hole, when the valve body opens by the second lift amount, the tangent line forming the smallest angle with the injection hole axis of the injection hole intersects with a downstream side of the opening of the injection hole, when the valve body is lifted by the first lift amount or the second lift amount, the projection is disposed outside of the injection hole, and the projection has a same height across a region larger than a diameter of the opening of the injection hole.

2. The fuel injector according to claim 1, wherein the first portion of the projection is located between the injection hole axis and an axis of the of the injection hole edge that is parallel to the injection hole axis.

3. The fuel injector according to claim 1, wherein the projection is formed annularly on the valve body side seat surface.

4. The fuel injector according to claim 3, wherein the annularly formed projection has a notch formed in a position not corresponding to the injection hole.

5. The fuel injector according to claim 1, wherein the smallest angle formed between the tangent line and the injection hole axis is $0° < \theta < 90°$.

6. The fuel injector according to claim 1, wherein the first portion of the projection is an outer edge of the projection.

7. The fuel injector according to claim 6, wherein the first portion of the projection is not disposed over the injection hole.

8. A fuel injector for injection of fuel, comprising:

a valve body having a valve body side seat surface;

a valve seat side seat surface that abuts on the valve body side seat surface; and an injection hole provided downstream of a position at which the valve body side seat surface abuts on the valve seat side seat surface, wherein a projection is formed on the valve body to project from the valve body side seat surface toward the injection hole, the projection guides the fuel from upstream of an injection hole edge of the injection hole by a predetermined guide angle and changes a direction of fuel flow to cause the fuel to flow downstream of the injection hole edge, in a valve open state, among a plurality of tangent lines formed upstream of a downstream end portion of the projection, a tangent line which forms a smallest angle with an injection hole axis of the injection hole intersects with an upstream side of an opening of the injection hole, wherein the injection hole axis of the injection hole is a central axis of the injection hole, a first portion of the projection located at an outer edge of the projection is located upstream of an upstream end portion of the opening of the injection hole, and a second portion of the projection at which the projection is most projected is located between the upstream end portion of the opening of the injection hole and the central axis of the injection hole, and the projection has a same height across a region larger than a diameter of the opening of the injection hole.

9. The fuel injector according to claim 8, wherein the valve body is configured to be selectively lifted by one of at least two lift amounts including a first lift amount and a second lift amount, the first lift amount being smaller than the second lift amount.

10. The fuel injector according to claim 9, wherein when the valve body opens by the second lift amount, the tangent line forming the smallest angle with the injection hole axis of the injection hole intersects with a downstream side of the opening of the injection hole.

* * * * *